US007096963B2

(12) United States Patent
Moncus et al.

(10) Patent No.: US 7,096,963 B2
(45) Date of Patent: Aug. 29, 2006

(54) SWING ARM CRANE AND METHOD

(75) Inventors: James Devin Moncus, Lafayette, LA (US); Joseph Hayden Miller, Jr., Lafayette, LA (US)

(73) Assignee: Devin International, Inc., Lafayette, LA (US)

( * ) Notice: Subject to any disclaimer, the term of this patent is extended or adjusted under 35 U.S.C. 154(b) by 234 days.

(21) Appl. No.: 10/788,148

(22) Filed: Feb. 26, 2004

(65) Prior Publication Data

US 2005/0189118 A1 Sep. 1, 2005

(51) Int. Cl.
*E21B 23/00* (2006.01)

(52) U.S. Cl. ..... 166/381; 166/77.2

(58) Field of Classification Search ..... 166/381, 166/77.2

See application file for complete search history.

(56) References Cited

U.S. PATENT DOCUMENTS 3,645,343 A * 2/1972 Mays ..... 173/195
4,610,315 A * 9/1986 Koga et al. ..... 175/85
4,703,811 A * 11/1987 Lam ..... 173/28
6,536,541 B1 * 3/2003 Pedrelli ..... 175/135
6,554,075 B1 * 4/2003 Fikes et al. ..... 166/379
6,569,024 B1 * 5/2003 Kleimeyer ..... 472/118

* cited by examiner

*Primary Examiner*—Frank S. Tsay
(74) *Attorney, Agent, or Firm*—C. Dean Domingue; Robert L. Waddel; Ted A. Anthony

(57) ABSTRACT

An apparatus for lifting and moving a load. The apparatus comprises a lift frame having a first and second vertical member that are connected so that a working window area is defined. The apparatus further comprises a rotary actuator mounted on the first vertical member, and an arm having a first end and a second end, and wherein the first end of the arm is pivotly connected to the rotary actuator. The arm is pivotal from an area exterior of the working window area to an area within the working window area. The apparatus may further comprise a winch, operatively attached to the arm, for lifting a load with the cable. A method of lifting a load is also disclosed.

18 Claims, 5 Drawing Sheets

SWING ARM CRANE AND METHOD

BACKGROUND OF THE INVENTION

This invention relates to a crane and method of using a crane. More specifically, but not by way of limitation, this invention relates to a swing arm crane and a method of using the crane to lift loads on a rig.

In the course of searching for oil and gas, operators drill in various regions of the globe, including the world's oceans. Many times, a floating type of drilling rig or floating production platform is utilized, as is well understood by those of ordinary skill in the art. During the course of drilling, completion, and/or production operations, operators may find it necessary to perform remedial well work.

Remedial well work can be performed with a coiled tubing unit, a snubbing unit, workover rig, etc. In the use of a coiled tubing unit and/or snubbing unit, operators will rig up a lift frame within the derrick. The lift frame is used to support injector heads, lubricators, etc. during the rig up, operation and rig down phases of the well work. Many times, the operator finds it necessary to lift equipment from a staging area to the work area within the lift frame.

Prior art equipment, such as cranes, have been used to aid operators in picking up and moving supplemental equipment from one point to another. However, oil field equipment is bulky. Prior art cranes and/or winches needed to lift this equipment are inadequate. In fact, operators will many times use a drilling rig's air tugger in order to lift and move equipment. However, air tuggers are generally ill suited and/or positioned for lifting this type of equipment. For instance, the air tuggers have a limited swing range of motion and have other uses for the rig crew.

Therefore, there is a need for a crane that will lift equipment. There is also a need for a crane that has a significant swing range of motion. There is also a need for a crane that can be used in conjunction with remedial well work on drilling and production platforms. The present invention will meet these needs, as well as others, as will be more readily understood by a reading of the following.

SUMMARY OF THE INVENTION

An apparatus for lifting and moving a load is disclosed. The apparatus comprises a lift frame having a first and second vertical member, and wherein the first and second vertical member are connected so that an inner portion is provided defining a working window area.

The apparatus further comprises a rotary actuator mounted on the first vertical member, and an arm having a first end and a second end, and wherein the first end of the arm is pivotly connected to the rotary actuator. The rotary actuator may be a hydraulic motor. The arm is pivotal from an area exterior of the working window area to an area within the working window area. The apparatus also includes a cable attached at a distal end to the first end of the arm and a proximal end to the load.

The apparatus may further comprise a bracket mounted on the first vertical member, with the bracket having a hinge operatively attached thereto. In the preferred embodiment, the second end of the arm is attached to the hinge so that the arm is pivotal from an area exterior of the working window area to an area within the working area. The apparatus may further comprise a winch means, operatively attached to the arm, for lifting a load with the cable. In one of the preferred embodiments, the winch means comprises a winch attached to the second end of the arm, and wherein the cable is partially spooled on the winch, with the cable being directed through a sheave attached to the first end of the arm, and wherein the sheave is pivotal from the area exterior of the working window area to the area within the working window area.

The lift frame may further comprise a coiled tubing injector head attached to the lift frame, and an elevation means for adjusting the orientation of the coiled tubing injector head. The elevation means comprises a means for moving the injector head in a horizontal plane and means for moving the injector head in a vertical plane.

The apparatus may further comprise a connector plate connected to the first and second vertical member and a lift sub operatively associated with a block contained within a derrick of a rig. In one preferred embodiment, the coiled tubing injector head is connected to a well head, and wherein the well head is connected to a well that extends to a subterranean zone.

A method for performing well work on a rig is also disclosed, wherein a well extends from the rig to a subterranean zone. The method comprises providing a well intervention string assembly on the rig. The well intervention string assembly includes a lift frame, with the lift frame comprising: a first and second vertical member, and wherein the first and second vertical member are connected so that an inner portion is provided defining a working window area; a rotary actuator mounted on the first vertical member; an arm attached to the first vertical member and wherein the arm is pivotal from an area exterior of the working window area to an area within the working window area; and a cable, operatively attached to the arm, for lifting a load.

The method further comprises rigging up a coiled tubing injector head to the lift frame. The method also comprises lifting a piece of supplemental equipment with the cable from the area exterior of the working window area. Thereafter, the arm is rotated with the rotary actuator so that the piece of supplemental equipment is rotated to within the working window area and the equipment is rigged up to the well intervention string assembly. A coiled tubing is lowered through the injector head into the well.

In one of the preferred embodiments, a second end of the arm is attached to a hinge and the hinge is attached to the first vertical member so that the arm is pivotal from an area out of the working window area to an area within the working area.

Also in one preferred embodiment, a connector plate is connected to the first and second vertical member and a lift sub is operatively attached with the block contained within the derrick of the rig, and wherein the lift sub is connected to the connector bar. In this embodiment, the step of rigging up the coiled tubing injector head includes suspending the lift frame from the derrick of the rig with the lift sub.

An advantage of the present invention is that an angle of rotation of 180 degrees is possible. Another advantage is that an operator may perform work within a work window and the swing arm crane can be pivoted outside the work window. Still yet another advantage is that the use of the device herein disclosed frees up other crane devices on a rig such as the air tuggers. Yet another advantage is that an operator may use power means that are already present on the rig, such as a hydraulic power source or a pneumatic power source.

A feature of the present invention includes use of a rotary actuator, such as a hydraulic motor, to pivot the arm. Another feature is that the arm freely rotates in an angle of rotation of at least 180 degrees. Still yet another feature is that the arm mounts to a support structure, such as a lift frame and the arm can rotate from an aft position to a fore position relative to the support structure. Yet another feature is that the winch, in one preferred embodiment, is attached to the bottom end of the arm, and the sheave is at the top end of the arm, thereby providing for a balanced mechanical design when lifting or lowering loads.

DETAILED DESCRIPTION OF THE PREFERRED EMBODIMENTS

Figure 1:
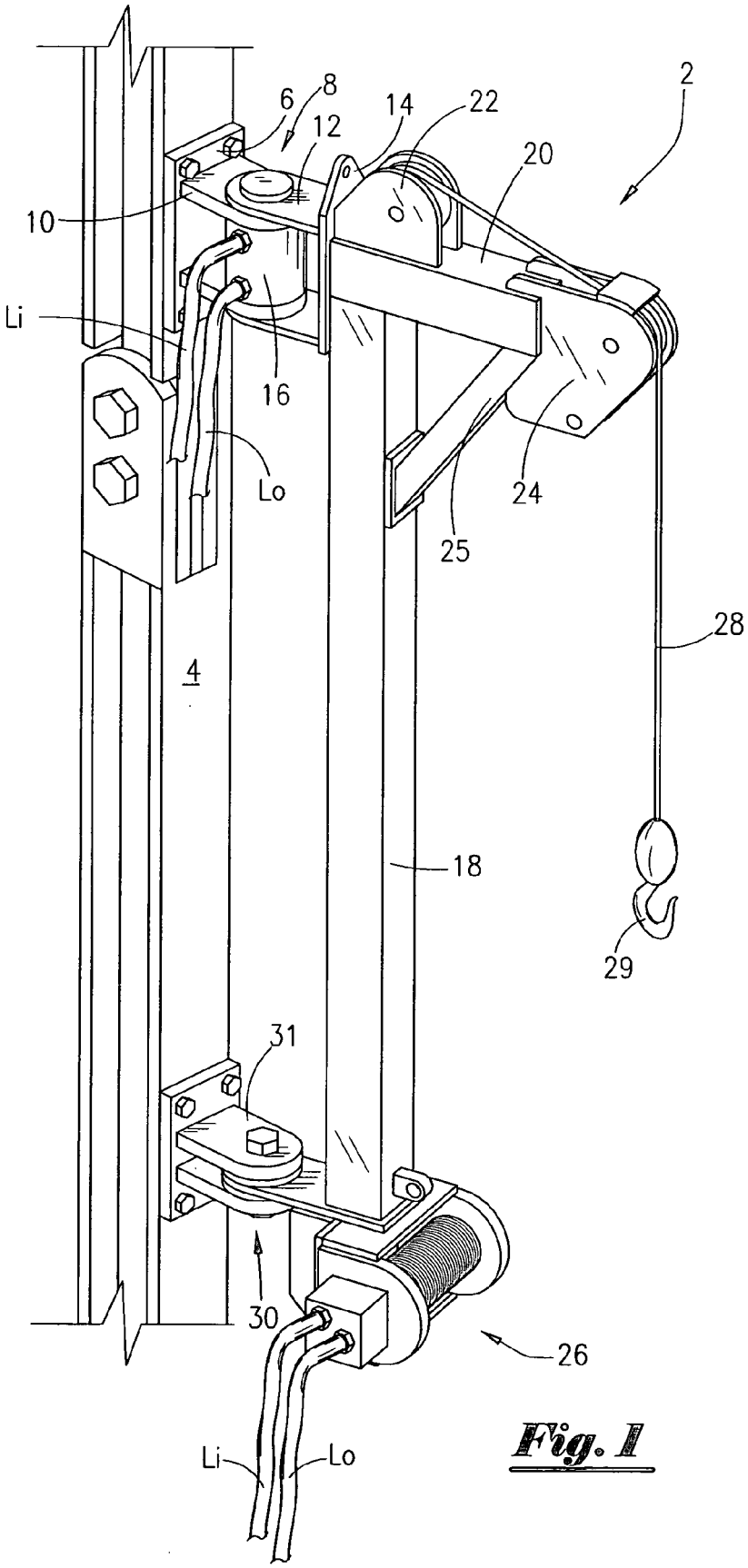
FIG. 1 is an isometric view of the swing arm crane attached to a support structure.

Referring now to FIG. 1, an isometric view of the swing arm crane 2 will now be described. The swing arm crane 2 is attached to a support structure 4. A base plate 6 is attached to the support structure 4 via nuts and bolts. Other attachment means are possible, such as attaching the base plate 6 via welding. The base plate 6 has a first hinge means 8 attached thereto, and wherein the first hinge means 8 has a first end 10 attached to the base plate 6 and a second end 12 connected to the attachment plate 14.

The first hinge means 8 will contain the rotary actuator means 16 for pivoting the swing arm 18, and wherein the arm 18 is pivotal from an area exterior of a working window area to an area within the working window area, as will be explained in greater detail later in the application. The rotary actuator means 16 is a hydraulic motor in one preferred embodiment, and wherein the motor is commercially available from Helac Corporation under the name Rotary Actuator (model no. L30-65E FT 180 52 OG). Hydraulic input line Li and output line Lo are shown. It should be noted that it is also possible to have a rotary actuator means 16 that is powered via a pneumatic power source. Extending from the attachment plate 14 is the member 20, and wherein the member 20 has connected thereto a first cable sheave 22 and a second cable sheave 24. An angle brace 25 for supporting the second cable sheave 24 is also provided.

At the bottom end of the arm 18 is the winch 26, and wherein the winch 26 will, in one preferred embodiment, be a two-ton winch with a 7/16 inch braided cable 28. In the most preferred embodiment, the winch 26 is a hydraulic winch, with FIG. 1 showing the input line Li and output line Lo. The cable 28 is directed from the winch 26, through the first cable sheave 22, then through the second cable sheave 24. As can be seen in FIG. 1, an attachment means 29 for attaching to supplemental equipment is provided on the distal end of the cable 28, and wherein in one preferred embodiment, the attachment means 29 is a hook 29. The proximal end of the cable 28 is attached to the winch 26. The winch 26 is pivotly attached to a second hinge means 30 and wherein the second hinge means 30 is connected to a bracket 31. As seen in FIG. 1, in the most preferred embodiment, the bracket 31 is attached to the support structure 4 via conventional means such as nuts and bolts. As noted earlier, other means are possible such as welding.

Note that in FIG. 1, the swing arm crane 2 is in a balanced state in that the cable 28, that leads from an aft attached winch 26, extends to the first cable sheave 22 which in turn extends perpendicularly to the second sheave 24 and wherein the cable 28 then extends perpendicularly therefrom, and wherein the cable 28 will then be attached to a load. In this configuration, when a load is lifted, the moment created at base plate 6 will tend to want to rotate the bottom end of the arm 18 outward; however, since the arm 18 is attached to the support structure 4 via the second hinge means 30, the force will be countered by the support structure 4, and the swing arm crane 2 is in a stable state. Additionally, the swing arm crane 2 remains in this stable state through the 180 degree range of motion i.e. from a position fore and aft of the support structure 4.

Figure 2:
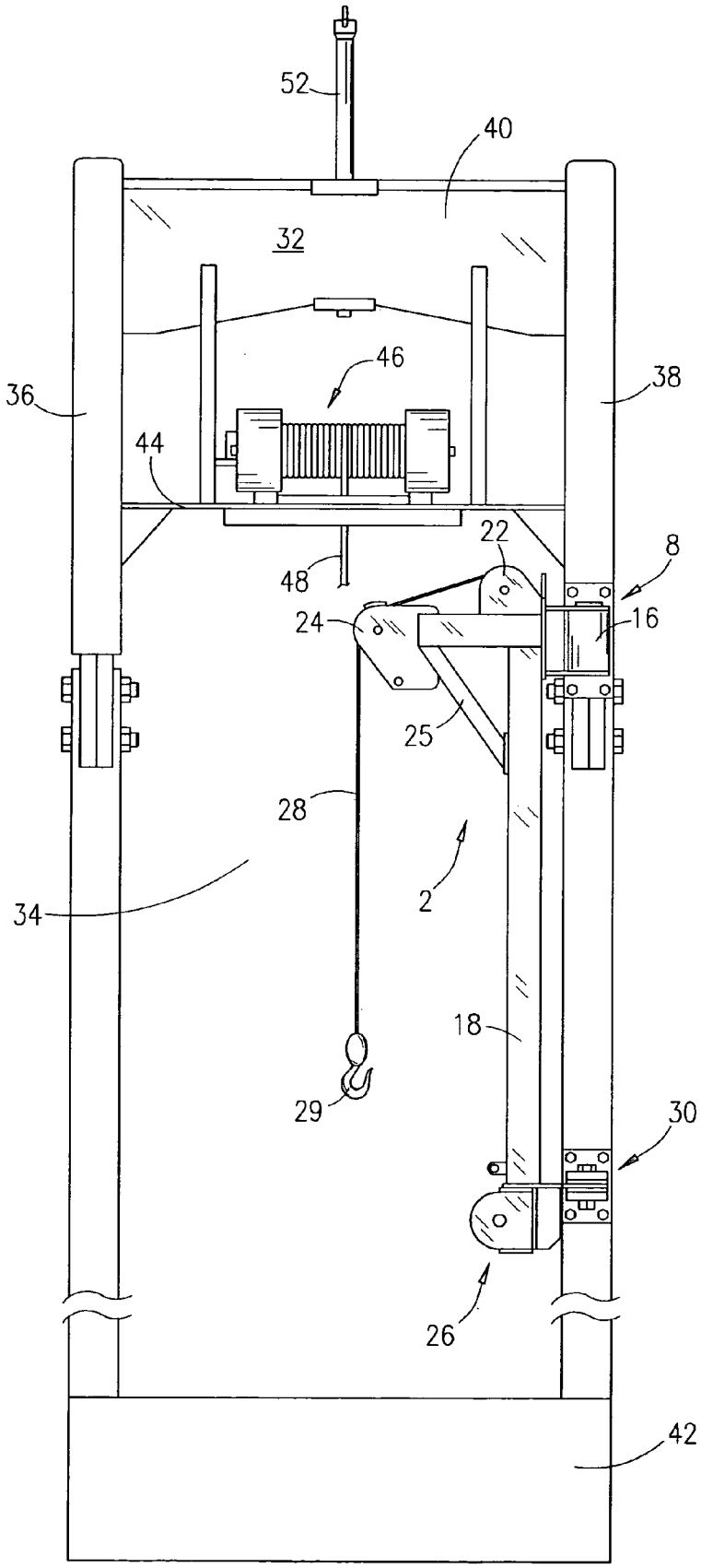
FIG. 2 is front plan elevation view of the swing arm crane mounted on a lift frame, with the swing arm crane positioned within the working area.

Referring now to FIG. 2, a front plan elevation view of the swing arm crane 2 mounted on a lift frame 32 is illustrated. The lift frame 32 is commercially available from Devin International Inc. under the name Coiled Tubing Lift Frame. The swing arm crane 2 is shown within a working area window, with the working area window being designated by the numeral 34. It should be noted that like numbers appearing in the various figures refer to like components. In one of the preferred embodiments, the lift frame 32 comprises generally a first vertical member 36 and a second vertical member 38.

The vertical members are connected via a top connector plate 40 and a bottom connector plate 42, and wherein the connector plates 40, 42 structurally connect the vertical members 36, 38. Also included in the lift frame 32 is the winch mounting plate 44, and wherein the winch mounting plate 44 is connected at both ends to the vertical members 36, 38 as shown in FIG. 2. The winch mounting plate 44 also has the second winch means 46 for winching equipment and other loads as desired by the operator. For instance, the second winch means 46 can be used to lift and lower the coil tubing injector head (which can be seen in FIG. 6). Returning to FIG. 2, the cable 48 is shown partially spooled on the second winch means 46 and can be used to aid in rigging up the coiled tubing injector head.

Figure 6:
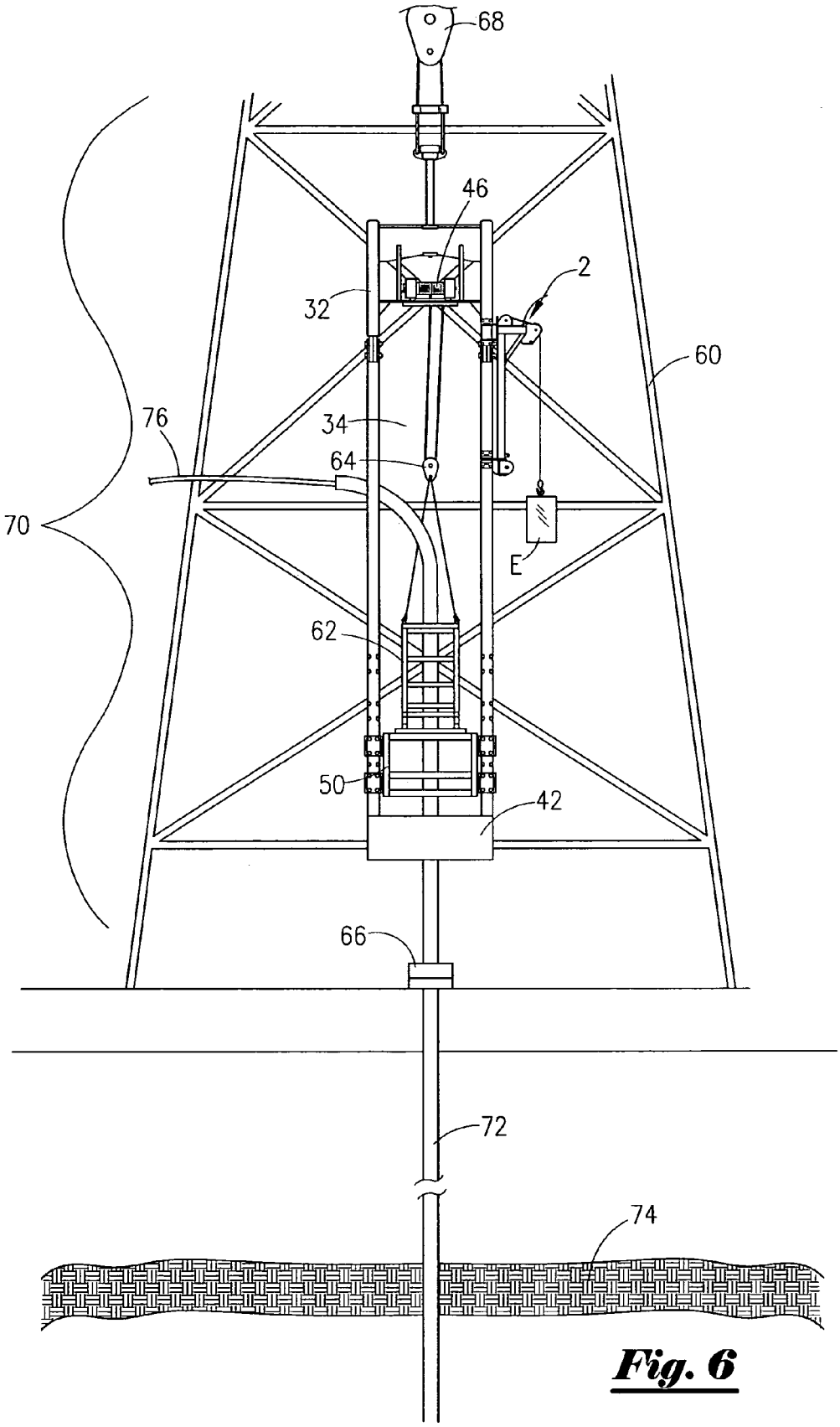
FIG. 6 is an isometric view of the swing arm crane attached to a coiled tubing lift frame positioned on a rig.

As shown in FIG. 6, the lift frame 32 can also have an elevation device 50 for the coiled tubing injector head operatively attached to the lift frame 32. As illustrated in FIG. 6, the elevation device 50 is operatively included, and wherein the elevation device 50 is commercially available from Devin International Inc. under the name Mini-Track. The elevation device 50 can lift in a vertical plane and can also move in horizontal plane in order to move the injector head for various operational purposes, as will be understood by those of ordinary skill in the art.

Returning to FIG. 2, FIG. 2 also depicts a lift sub 52. The lift sub 52 allows attachment to elevators (not shown), wherein the elevators will be suspended in the derrick of the rig via the block, as will be explained in more detail later in the application.

Figure 3:
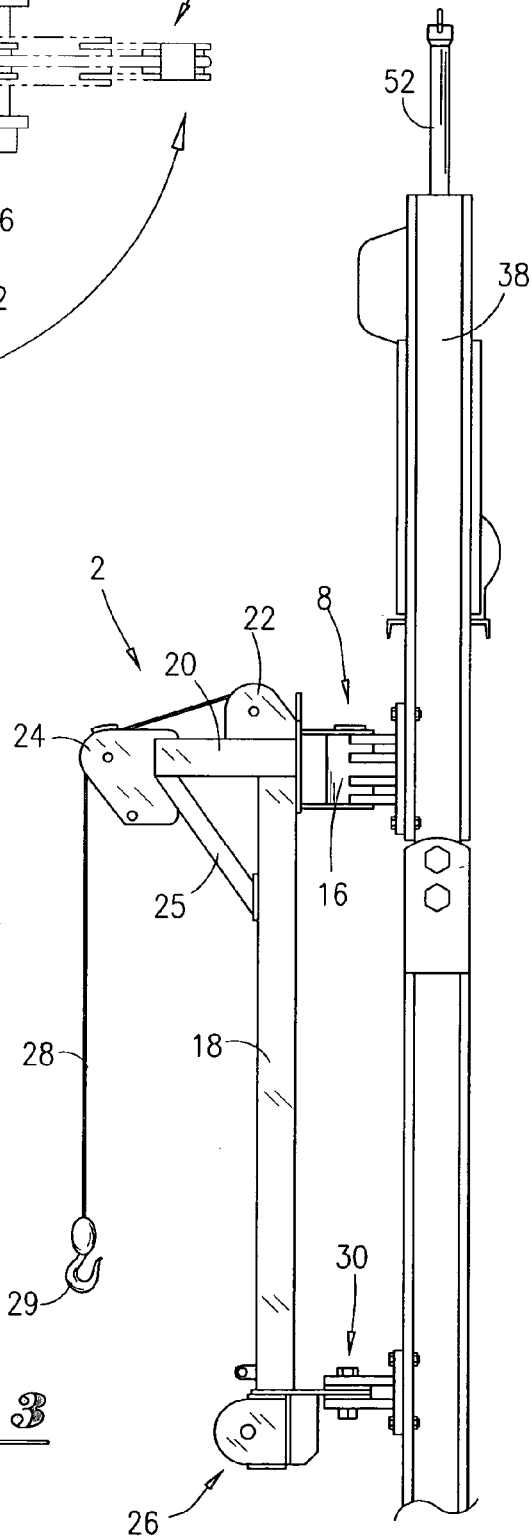
FIG. 3 is a side plan elevation view of the lift frame of FIG. 2, wherein the swing arm crane has been pivoted 90 degrees.

FIG. 3 is a side plan elevation view of the lift frame of FIG. 2 wherein the swing arm crane 2 has been pivoted 90 degrees from the position illustrated in FIG. 2. Hence, the second vertical member 38 is shown. The swing arm crane 2 is on the outer periphery of the working window area 34.

Figure 4:
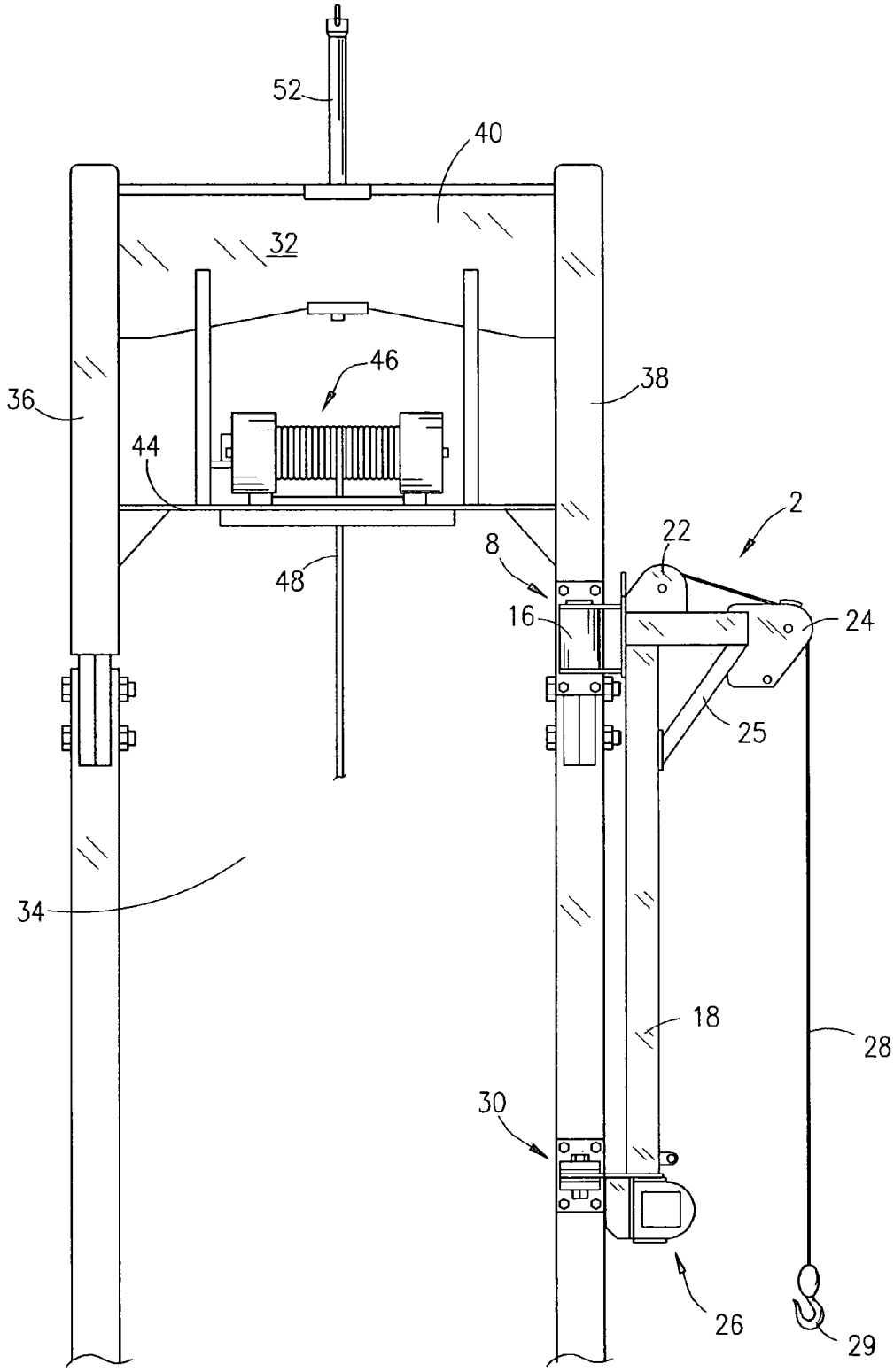
FIG. 4 is a front plan elevation view of the swing arm crane with the swing arm crane mounted on the lift frame, with the swing arm crane being pivoted exterior of the working area.

In FIG. 4, a front plan elevation view of the swing arm crane 2 mounted on the lift frame 32 is shown, and in FIG.

4, the swing arm crane 2 has been pivoted 180 degrees from the orientation seen in FIG. 2. In FIG. 4, the swing arm crane 2 is exterior of the working area window 34. In other words, the swing arm crane 2 is no longer positioned within the working area window 34. The swing arm crane 2 has been pivoted by the rotary actuation means 16. As noted earlier, the rotary actuation means 16 is in one of the preferred embodiments a hydraulic motor.

One of the features of the present invention is that the swing arm crane 2 can move from the area 34 to the area exterior of the working area window 34 via pivoting at the first hinge 8 and the second hinge 30. The swing arm crane 2 can also move from the area exterior of the working area window 34 to the area inside the working area window 34.

As is understood by those of ordinary skill in the art, the coiled tubing injector head is rigged up within the working area window using the second winch means 46. The coiled tubing injector head is rigged up to the well intervention string assembly. The well intervention string assembly (as seen in FIG. 6) is the surface work string connected at one end to the well and at the second end to the block. In operation, the operator may find it necessary to also rig up supplemental equipment, such as Blow Out Preventors, lubricators, down hole tools, assemblies, etc. to the well intervention string assembly. The supplemental equipment is an appendage to the well intervention string assembly. Hence, the, supplemental equipment can be picked-up with the swing arm crane 2 and wherein the supplemental equipment is outside the working area window (for instance, on the deck of the rig). The swing arm crane 2, with the attached supplemental equipment, is rotated to within the working area window 34, and wherein the supplemental equipment can be rigged up to the well intervention string assembly as needed. Therefore, the workers have installed certain appendage supplemental equipment with the aid of the swing arm crane 2.

Figure 5:
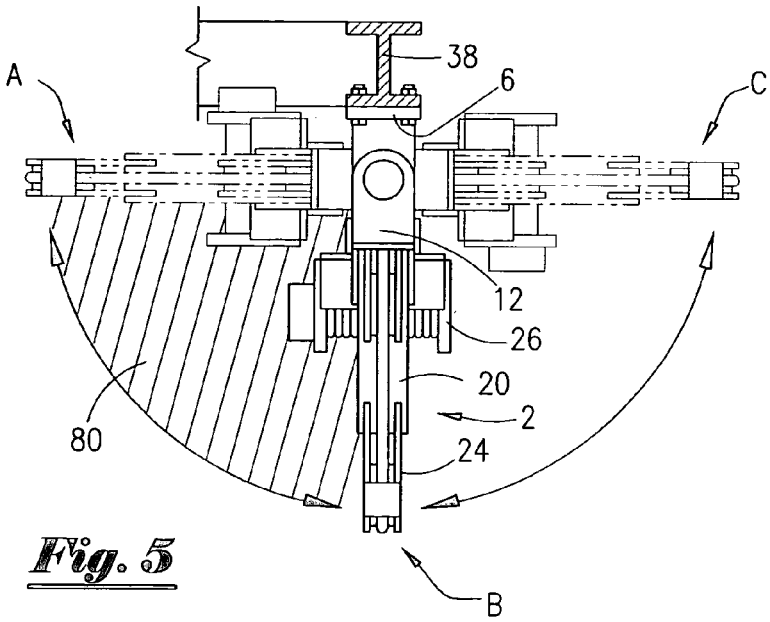
FIG. 5 is a top plan view of the swing arm crane seen in FIG. 4 illustrating the range of motion.

FIG. 5 depicts a top plan view of the swing arm crane 2 seen in FIG. 4. FIG. 5 illustrates the range of motion. The position denoted by the letter A shows the swing arm crane 2 oriented within the working area window 34. The position denoted by the letter B shows the swing arm crane 2 having been rotated 90 degrees from the A position, which is still within the working area window 34. Once the swing arm crane 2 is rotated to approximately 91 degrees, the swing arm crane 2 is exterior of the working window area 34. Hence, the swing arm crane 2 is within the inner portion 34 when the swing arm crane 2 is within this 90 degree (right angle) range denoted by the shaded area 80. The C position shows the swing arm crane 2 having been rotated 180 degrees from the A position, which is also exterior of the working area window 34.

Referring now to FIG. 6, an isometric view of the swing arm crane 2 attached to the lift frame 32 positioned within a derrick 60 of rig is shown. A coiled tubing injector head 62 is shown being positioned within the working area window 34. The coiled tubing injector head 62 is commercially available from Hydra Rig Corporation under the name Coiled Tubing Injector Head. The second winch means 46 has a hoist 64 operatively associated therewith and wherein the hoist is operatively attached to the coiled tubing injector head 62. The swing arm crane 2 has been moved to a position exterior of the working area window 34. The coiled tubing injector head 62 is rigged up to the well head, seen generally at 66. The elevation device 50 may be used to lift the coiled tubing injector head 62 for various purposes during operations. The surface work string and assembly connected at one end to the well head 66 and at the opposite end to the block 68 is collectively referred to as the well intervention string assembly 70.

The well head 66 connects to a subterranean well 72 that intersects a hydrocarbon bearing reservoir 74. In the position seen in FIG. 6, the operator can use the swing arm crane 2 to aid in rigging up, or rigging down, by lifting supplemental equipment E required during operations, such as rigging up or rigging down BOPs, lubricators, down hole tools, assemblies, etc., as noted earlier. Once the head 62 is rigged up, the operator can run into the well with coiled tubing 76 and perform the necessary well work, as is readily understood by those of ordinary skill in the art. After the well work, the swing arm crane 2 can be used to rig down the equipment.

Changes and modifications in the specifically described embodiments can be carried out without departing from the scope of the invention which is intended to be limited only by the scope of the appended claims and any equivalents thereof.

We claim:

1. An apparatus for moving a load on a drilling rig comprising:
   - a lift frame, said lift frame comprising a first vertical member and a second vertical member, and wherein said first vertical member and said second vertical member are connected so that an inner portion is provided defining a working window area;
   - a rotary actuator mounted on the first vertical member;
   - an arm having a first end and a second end, and wherein said first end of said arm is pivotly connected to said rotary actuator, and wherein said arm is pivotal from an area exterior of the working window area to an area within the working window area;
   - a cable attached at a distal end to said first end of said arm and a proximal end to the load.

2. The apparatus of claim 1 wherein the rotary actuator includes: a base plate mounted on said first vertical member; a hinge operatively attached to said base plate; and wherein said second end of said arm is attached to said hinge so that said arm is pivotal from an area exterior of the working window area to an area within the working window area.

3. The apparatus of claim 1 further comprising:
   - winch means, operatively attached to said arm, for lifting the load with the cable.

4. The apparatus of claim 3 wherein said winch means comprises:
   - a winch attached to the second end of the arm; and wherein said cable is partially spooled on the winch;
   - a sheave attached to the first end of said arm, wherein said cable is directed through said sheave and wherein said sheave pivots from the area exterior of the working window area to the area within the working window area.

5. The apparatus of claim 4 wherein said lift frame further comprises:
   - a coiled tubing injector head attached to said lift frame;
   - an elevation means for adjusting the orientation of said coiled tubing injector head.

6. The apparatus of claim 5 further comprising a connector plate connected to the first and second vertical member and a lift sub operatively associated with a block contained within a derrick of a rig.

7. The apparatus of claim 6 wherein said coiled tubing injector head is connected to a well head, and wherein the well head is connected to a well that extends to a subterranean zone.

8. The apparatus of claim 1 wherein the rotary actuator comprises a hydraulic motor.

9. An apparatus for use on a drilling rig comprising:

a frame having a first vertical member and a second vertical member, and wherein said first vertical member and said second vertical member are connected so that an inner portion is provided defining a working window area;

a motor mounted on the first vertical member;

an arm having a first end and a second end, and wherein said first end of said arm is pivotly connected to said motor, and wherein said arm is pivotal from an area exterior of the working window area to an area within the working window area;

a bracket mounted on said first vertical member, said bracket having a hinge operatively attached thereto; and wherein said second end of said arm is attached to said hinge so that said arm is pivotal from an area exterior of the working window area to an area within the working window area;

winch means, operatively attached to said arm, for winching a load.

10. The apparatus of claim 9 further comprising a connector plate connected to the first and second vertical member and a lift sub operatively associated with a block contained within a derrick of the rig, and wherein the lift sub is connected to said connector plate.

11. The apparatus of claim 10 wherein said frame further comprises:

a coiled tubing injector head attached to said frame;

an elevation means for adjusting the orientation of said coiled tubing injector head.

12. The apparatus of claim 11 wherein said winch means comprises:

a winch attached to the second end of the arm;

a cable spooled partially on the winch;

a sheave attached to the first end of said arm, with said cable being directed through the sheave and wherein said sheave is pivotal from the area exterior of the working window area to the area withing the working window area.

13. The apparatus of claim 12 wherein said injector head is connected to a well head, and wherein the well head is connected to a well that extends to a subterranean zone.

14. The apparatus of claim 13 wherein the motor comprises a hydraulic motor.

15. A method for performing remedial well work on a rig, and wherein a well extends from the rig to a subterranean zone, the method comprising:

providing a well intervention string assembly on the rig, said well intervention string assembly including a lift frame, said lift frame comprising: a first vertical member and a second vertical member, and wherein said first vertical member and said second vertical member are connected so that an inner portion is provided defining a working window area; a rotary actuator mounted on the first vertical member; an arm attached to said first vertical member and wherein said arm is pivotal from an area exterior of the working window area to an area within the working window area; and a cable, operatively attached to said arm, for lifting a load;

rigging up a coiled tubing injector head to the lift frame;

lifting a piece of supplemental equipment with the cable from an area exterior of the working window area;

rotating the arm with the rotary actuator so that the piece of supplemental equipment from the area exterior of the working window area is rotated to within the working window area;

rigging up the piece of supplemental equipment to the well intervention string assembly;

lowering a coiled tubing through the injector head into the well.

16. The method of claim 15 wherein the second end of said arm is attached to a hinge and the hinge is attached to said first vertical member, and wherein the step of rotating the arm includes rotating the arm with the rotary actuator and said hinge.

17. The method of claim 16 wherein the cable is partially spooled on a winch device, and the step of lifting the piece of equipment includes winching the cable onto the winch device.

18. The method of claim 17 wherein a connector plate is connected to the first and second vertical member and a lift sub is operatively attached with a drawworks contained within a derrick of the rig, and wherein the lift sub is connected to said connector plate; and the step of rigging up the coiled tubing injector head includes suspending the lift frame from the derrick of the rig with the lift sub.

* * * * *